United States Patent [19]

Comp

[11] Patent Number: 4,904,363

[45] Date of Patent: Feb. 27, 1990

[54] SELECTIVE PLATING SYSTEMS

[75] Inventor: Richard J. Comp, Milford, Conn.

[73] Assignee: Burndy Corporation, Norwalk, Conn.

[21] Appl. No.: 343,011

[22] Filed: Apr. 25, 1989

[51] Int. Cl.[4] ..... C25D 17/00

[52] U.S. Cl. ..... 204/202; 204/224 R

[58] Field of Search ..... 204/202, 224 R

[56] References Cited

U.S. PATENT DOCUMENTS

| | | | |
|---|---|---|---|
| 3,657,097 | 4/1972 | Baldock et al. | 204/202 |
| 3,951,772 | 4/1976 | Bick et al. | 204/198 |
| 4,032,414 | 6/1977 | Helder et al. | 204/15 |
| 4,070,265 | 1/1978 | Danneels et al. | 204/206 |
| 4,278,520 | 7/1981 | Turner | 204/207 |
| 4,279,730 | 7/1981 | Noz | 204/206 |
| 4,321,124 | 3/1982 | Audelo | 204/202 |
| 4,401,522 | 8/1983 | Buschow et al. | 204/15 |
| 4,508,611 | 4/1985 | Johnson et al. | 204/202 |
| 4,534,843 | 8/1985 | Johnson et al. | 204/202 |
| 4,539,090 | 9/1985 | Francis | 204/198 |
| 4,545,884 | 10/1985 | Francis | 204/202 |

*Primary Examiner*—T. M. Tufariello

*Attorney, Agent, or Firm*—Perman & Green

[57] ABSTRACT

A selective electroplating apparatus includes a flexible conveyor belt for receiving contact pins, one portion of each contact pin extending from one side of the conveyor belt and a second portion extending from the opposite side of the conveyor belt. A reel constrains the travel of the conveyor belt into a loop which is defined by a substantially vertical plane, the web of the conveyor belt being oriented in a substantially horizontal alignment and the loop having upper and lower elongated regions. By this structure, the reel causes one portion of the contact pins to be oriented downwardly from the belt in the upper elongated region and another portion of the contact pins to be oriented downwardly from the belt in the lower elongated region. At least one plating tank is provided adjacent the upper elongated region for contacting the downwardly extending portions of the contact pins and another plating tank is provided adjacent the lower elongated region for contacting the downwardly extending portions of the contact pins.

8 Claims, 1 Drawing Sheet

SELECTIVE PLATING SYSTEMS

FIELD OF THE INVENTION

This invention relates to electroplating and more particularly to the selective electroplating of different areas of a part with different materials.

BACKGROUND OF THE INVENTION

Electrical connectors are often fabricated using a plurality of independent pins held in a spaced-apart fashion by a nonconductive support member. The portion of the pins which make contact with a female connector are preferably plated with a thin layer of gold or other precious metal which exhibits the properties of excellent conductivity while, at the same time, evidencing good corrosion resistance. The opposite ends of the connector pins are generally plated with a lead/tin coating to enable a good solder connection to be achieved when conductors are connected thereto and the assembly heated. Thus, the optimum connector pin is selectively plated, at one end, with a precious metal which provides good electrical contact and corrosion resistance, while at the other end, with a lead/tin material for solderability purposes. It is not desirable to plate the entire pin with the precious metal as that adds considerably to the expense. Various connector pin plating systems are known in the prior art. In U.S. Pat. No. 4,321,124 to Audelo a selective loose parts plating apparatus is shown wherein the parts are carried in apertures in a continuous belt. The portion of each part that is desired to be selectively plated is moved by the belt through a plating solution so that only that portion which extends into the solution is plated. Similar systems are shown in U.S. Pat. No. 4,279,730 to Noz, U.S. Pat. No. 4,545,884 to Francis and U.S. Pat. No. 3,657,097 to Baldock et al. In each of the aforementioned patents, consideration is only given to plating one side of a connector pin, with little apparent attention given to the nonplated end.

In other prior art, it is known to reorient connector pins so that their nonplated ends may be selectively electroplated with another material. In such instances, the pins are often removed from the conveyor belt, reoriented and moved to another conveyor belt for the second plating operation. This requires separate plating lines, significant handling of the pins, allocation of substantial manufacturing space to the second plating line and generally results in an increased cost for the product.

Accordingly, it is an object of this invention to provide an improved selective plating system for connector pins, which system occupies minimum manufacturing floor space.

It is another object of this invention to provide an improved selective plating system for connector pins wherein pin handling is minimized.

It is still another object of this invention to minimize the amount of precious metal which must be used in a selective electroplating apparatus for connector pins.

SUMMARY OF THE INVENTION

A selective electroplating apparatus for elongated members is disclosed which includes a flexible conveyor belt for receiving the elongated members, one portion of each elongated member extending from one side of the conveyor belt and a second portion extending from the opposite side of the conveyor belt. Guide means are provided which constrain the travel of the conveyor belt into a loop which is defined by a substantially vertical plane, the web of the conveyor belt being oriented in a substantially horizontal alignment and the loop having upper and lower elongated regions. By this structure, the guide means causes one portion of the elongated members to be oriented downwardly from the belt in the upper elongated region and another portion of the elongated members to be oriented downwardly from the belt in the lower elongated region. At least one plating tank is provided adjacent the upper elongated region for contacting the downwardly extending portions of the elongated members and another plating tank is provided adjacent the lower elongated region for contacting the downwardly extending portions of the elongated members.

DETAILED DESCRIPTION OF THE INVENTION

Figure 1:
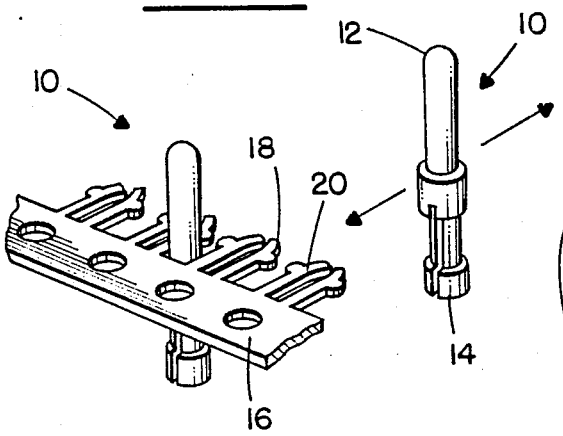
FIG. 1 is a perspective view of a conveyor belt and the connector pins which are to be electroplated.

Referring now to FIG. 1, a metal connector pin 10 is shown which comprises one end 12 over which a conductor may be either wire wrapped or connected via an enveloping female interconnection unit. The other end 14 of pin 10 will mate with a male connector once it is assembled into a multipin connector during subsequent manufacture. End 12 of pin 10 is to be electroplated with a lead/tin coating so as to enable subsequent soldering thereof. End 14 of pin 10 is to be electroplated with a thin layer of gold that provides both corrosion protection and improved electrical conductivity over the pin's lifetime. Each pin 10 is mounted between a pair of fingers 18 and 20 which extend from one side of conveyor belt 16. Belt 16 moves the pins 10 through a series of electroplating baths to accomplish the above described selective deposition of materials thereon. Fingers 18 and 20 grip each pin 10 at a point in its center that does not require plating. Conveyor belt 16 is preferably comprised of a flexible, electrically conductive material such as cartridge brass. This enables electrical contact to be made through conveyor belt 16 to the respective pins 10 as they pass through the various electroplating baths.

Figure 2:
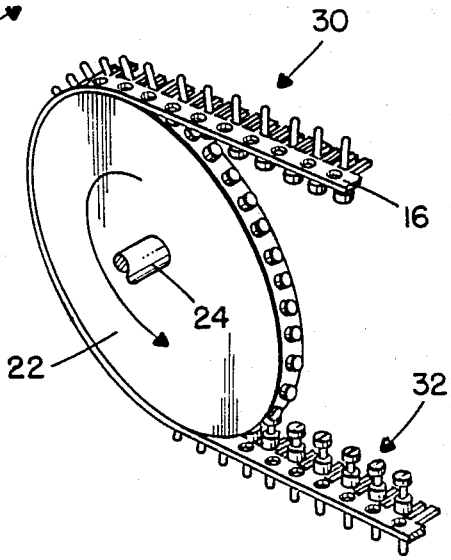
FIG. 2 is a perspective view of a rotary guide wheel which is employed to move the pins and associated conveyor belt from one series of electroplating baths to another series of electroplating baths.

Referring to FIG. 2, conveyor belt 16, in its travel through the electroplating systems, passes over a vertically oriented reel 22 which is mounted for rotation about a horizontal axis 24. Reel 22 is provided with a plurality of protrusions about its periphery which interact with apertures in conveyor belt 16 to aid in the incremental movement of belt 16 through the electroplating process. As a result of the vertical orientation of reel 24 and the horizontal orientation of the web of belt 16, it can be seen that pins 10 riding along the upper run 30 of belt 16 will have their portions 14 oriented below belt 16. Along the lower run 32 of belt 16 however, portions 12 of pins 10 will extend below belt 16. The reorientation resulting from the action of reel 22, enables the selective plating of ends 12 and 14 of each pin 10 with different materials while avoiding any need for pin handling between the subsequent plating operations. Moreover, it enables entirely different plating lines to be superimposed, one over the other vertically, to enable a substantial savings in manufacturing floor space.

Figure 3:
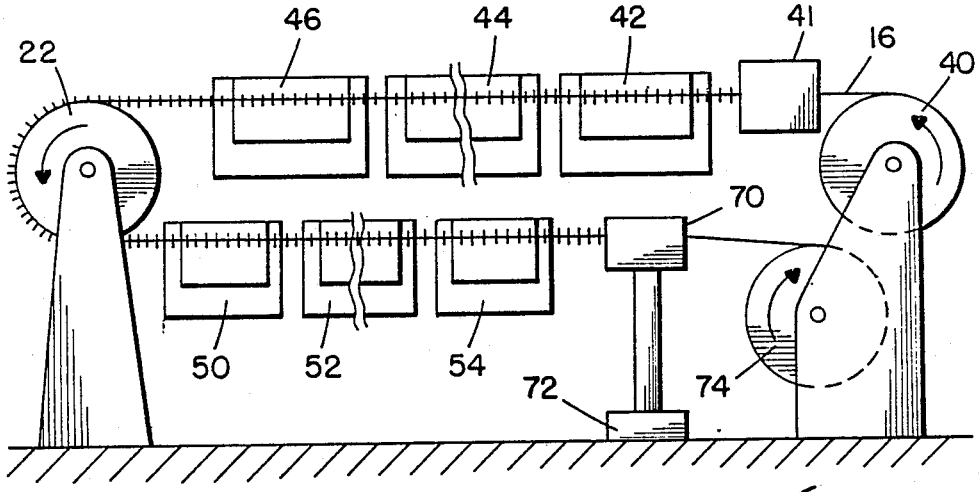
FIG. 3 is a schematic view of the overall electroplating system showing the vertical arrangement of the different electroplating baths.
Figure 4:
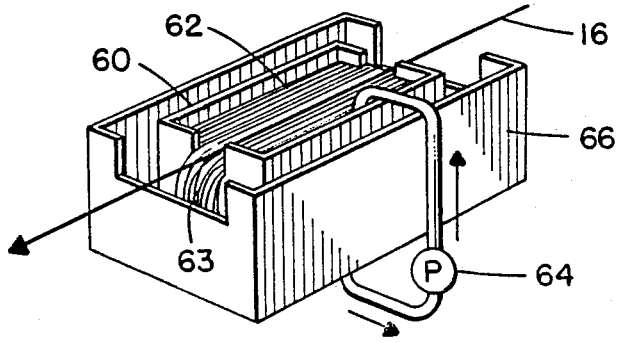
FIG. 4 is a perspective view of an exemplary electroplating bath.

The above selective plating process is schematically shown in the layout of FIG. 3. Payout reel 40 has wound about it, a length of conveyor belt 16. As it is caused to rotate in a counterclockwise direction, belt 16 moves in a direction to the left towards loading station 41 and baths 42, 44 and 46. Loading station 41 is placed adjacent belt !6 and accomplishes the insertion of pins 10 into the respective holding fingers 18 and 20. If it is assumed that pins 10 are loaded onto belt 16 as shown in FIG. 1, then baths 42, 44, 46 etc. are components of a gold electroplating line whereas baths 50, 52, 54 etc. are components of a lead/tin electroplating line. Each electroplating line is, in itself, standard and is well known. (None of the electrical contacts nor power sources required for electroplating are shown) For instance, an electroplating line for gold will first comprise an alkaline cell 42 which contains a plurality of wiper/rinses and an alkali bath. One wiper/rinse is located before the bath and the other is after the bath. Inside the bath itself, the carrier strip and pins are totally immersed in a hot bath of an alkali solution which is electrified to remove oils and dirt from the belt and pins prior to plating. Subsequently, the pins pass through an acid cell which activates them for subsequent plating by removing oxidation from their surface through immersion in a warm acidic solution. Subsequently, a plurality of gold cells e.g. 44, 46 are provided and conveyor belt 16 is constrained so that only ends 14 of pins 10 pass through those baths. As shown in FIG. 4, each of the electroplating baths comprises an inner tank 60 which is filled with an electroplating solution 62. A wier 63 at the end of each tank 60 enables access and egress of conveyor belt 16 and partial immersion of the pins 10 into the solution 62. Solution 62 is maintained at the correct level by a pump 64 which causes the overflow from wier 63, which falls into tank 66, to be pumped back into the electroplating tank 60.

As pins 10 emerge from the gold plating line having had their ends 14 electroplated with gold, they pass around reel 22 which causes, as aforestated, ends 12 to be oriented in a downward fashion. Ends 12 then pass through baths 50, 52, 54 etc. and achieve a lead/tin plating. As aforestated, the tin/lead plating line is standard and known in the prior art. Tanks 52 and 54 are tin/lead electroplating cells which have the identical form as that shown in FIG. 4.

As conveyor belt 16 exits from tank 54, it passes through an unloading station 70 where the pins are removed from between fingers 18 and 20 and are deposited in receptacle 72 for subsequent use. Conveyor belt 16 then passes to take-up reel 74.

It should be understood that the foregoing description is illustrative of the invention. Various alternatives and modifications can be devised by those skilled in the art without departing from the invention thus. Thus, while the invention has been described with respect to the selective plating of connector pins, it is equally applicable to the selective electroplating of any elongated member. Accordingly, the present invention is intended to embrace all such alternatives modifications and variances which fall within the scope of the appended claims.

I claim:

1. An apparatus for selectively electroplating portions of elongated members, said apparatus comprising:

a flexible conveyor belt for receiving said elongated members, one portion of each said elongated member extending from one side of said conveyor belt and a second portion of each said elongated member extending from another side of said conveyor belt;

guide means for said conveyor belt, constraining the travel thereof into a loop defined by a substantially vertical plane, with the web of said conveyor belt oriented in a substantially horizontally alignment, said loop having upper and lower regions, said guide means causing said one portion of each said elongated member to be oriented downwardly from said belt in said upper region and said second portion of each said elongated member to be oriented downwardly from said belt in said lower region;

at least one plating tank adjacent said upper region for contacting said one portion of each said elongated member; and at least a second plating tank adjacent said lower region for contacting said second portion of each said elongated member.

2. The invention as defined in claim wherein said conveyor belt includes fingers which grasp each said elongated member.

3. The invention as defined in claim 2 wherein said conveyor belt is a web of a metal alloy.

4. The invention of claim 3 wherein said fingers are formed integrally from the material of said conveyor belt.

5. The invention of claim 4 wherein said guide means includes a direction reversal reel about which said conveyor belt moves.

6. The invention of claim 4 wherein said one plating tank contains a solution comprising a first metal and said second plating tank contains a solution comprising a second metal.

7. The invention of claim 6 wherein said first tank contains a gold solution and said second tank a lead/tin solution.

8. The invention of claim 7 wherein the plating tanks include wiers to allow entrance and exit of said conveyor belt through plating solutions.

* * * * *